US009064410B2

(12) United States Patent
Hatano

(10) Patent No.: US 9,064,410 B2
(45) Date of Patent: Jun. 23, 2015

(54) LIGHT EMITTING DIODE TRAFFIC LIGHT

(71) Applicant: NICHIA CORPORATION, Anan-shi (JP)

(72) Inventor: Tomohiko Hatano, Naruto (JP)

(73) Assignee: NICHIA CORPORATION, Anan-shi (JP)

( * ) Notice: Subject to any disclaimer, the term of this patent is extended or adjusted under 35 U.S.C. 154(b) by 0 days.

(21) Appl. No.: 14/266,843

(22) Filed: May 1, 2014

(65) Prior Publication Data

US 2014/0334150 A1 Nov. 13, 2014

(30) Foreign Application Priority Data

May 8, 2013 (JP) ..... 2013-098052

(51) Int. Cl.
*G08G 1/095* (2006.01)

(52) U.S. Cl.
CPC ..... *G08G 1/095* (2013.01)

(58) Field of Classification Search
USPC ..... 362/545, 249.02, 800, 97.3, 341, 346, 362/296.1, 297
See application file for complete search history.

(56) References Cited

U.S. PATENT DOCUMENTS

| | | | | |
|---|---|---|---|---|
| 7,530,711 | B2 * | 5/2009 | Bang | 362/241 |
| 2005/0231949 | A1 * | 10/2005 | Kim et al. | 362/249 |
| 2009/0146921 | A1 * | 6/2009 | Takahashi | 345/55 |
| 2013/0194799 | A1 * | 8/2013 | Wu et al. | 362/240 |

FOREIGN PATENT DOCUMENTS

| | | |
|---|---|---|
| JP | 11-007598 | 1/1999 |
| JP | 11-203914 | 7/1999 |
| JP | 11-231815 | 8/1999 |
| JP | 11-265499 | 9/1999 |
| JP | 2000-181363 | 6/2000 |
| JP | 2006-243418 | 9/2006 |
| JP | 2009-146936 | 7/2009 |

* cited by examiner

*Primary Examiner* — Laura Tso
(74) *Attorney, Agent, or Firm* — Mori & Ward, LLP

(57) ABSTRACT

An LED (light emitting diode) traffic light includes a circuit board, a plurality of LEDs, and a masking plate. The masking plate has a plurality of through-holes. The masking plate is provided such that a back side of the masking plate faces a front side of the circuit board and the plurality of through-holes corresponds to the plurality of LEDs. The masking plate has a plurality of protruding ridges on a front side of the masking plate. Each of the plurality of protruding ridges has an upward facing inclined surface that slants downward at a first angle and a downward facing inclined surface that slants upward at a second angle larger than the first angle. The plurality of protruding ridges include a first ridge and a second ridge. The first angle of the first ridge is different from the first angle of the second ridge.

23 Claims, 5 Drawing Sheets

LIGHT EMITTING DIODE TRAFFIC LIGHT

BACKGROUND OF THE INVENTION

1. Field of the Invention

The present invention relates to a light emitting diode (LED) traffic light (traffic signal) that uses LEDs (as the light source).

2. Description of the Related Art

In recent years, traffic lights using LEDs have been proposed.

For example, Japanese Laid-Open Patent Publication HEI11-7598 (1999) discloses improved visual recognition of the traffic signal by establishing an anti-reflection section in the LED traffic light.

However, the LED traffic light disclosed in Japanese Patent Publication HEI11-7598 (1999) cannot sufficiently suppress light reflection and leaves room for further improvement.

SUMMARY OF THE INVENTION

One implementation of the LED traffic light is provided with a circuit board, a plurality of LEDs, and a masking plate. The circuit board has a front side. The plurality of LEDs are provided on the front side of the circuit board. The masking plate has a front side and a back side opposite to the front side of the masking plate. The masking plate has a plurality of through-holes passing through the masking plate from the back side to the front side. The masking plate is provided such that the back side of the masking plate faces the front side of the circuit board and the plurality of through-holes corresponds to the plurality of LEDs. The masking plate has a plurality of protruding ridges on the front side of the masking plate. Each of the plurality of protruding ridges has an upward facing inclined surface that slants downward at a first angle and a downward facing inclined surface that slants upward at a second angle larger than the first angle. The plurality of protruding ridges include a first ridge and a second ridge. The first angle of the first ridge is different from the first angle of the second ridge.

Another implementation of the LED traffic light is provided with a circuit board, a plurality of LEDs, and a masking plate. The circuit board has a front side. The plurality of LEDs are provided on the front side of the circuit board. The masking plate has a front side and a back side opposite to the front side of the masking plate. The masking plate has a plurality of through-holes passing through the masking plate from the back side to the front side. The masking plate is provided such that the back side of the masking plate faces the front side of the circuit board and the plurality of through-holes corresponds to the plurality of LEDs. The masking plate has a plurality of protruding ridges on the front side of the masking plate. Each of the plurality of protruding ridges has an upward facing inclined surface that slants downward at a first angle and a downward facing inclined surface that slants upward at a second angle larger than the first angle. The plurality of protruding ridges include a first ridge and a second ridge. The second angle of the first ridge is different from the second angle of the second ridge.

DETAILED DESCRIPTION OF THE EMBODIMENT(S)

The following describes an embodiment of the present invention with reference to the figures. It should be noted that the embodiment described below is merely a specific example to illustrate the technology associated with the present invention, which is not limited to the embodiment described below.

Figure 1:
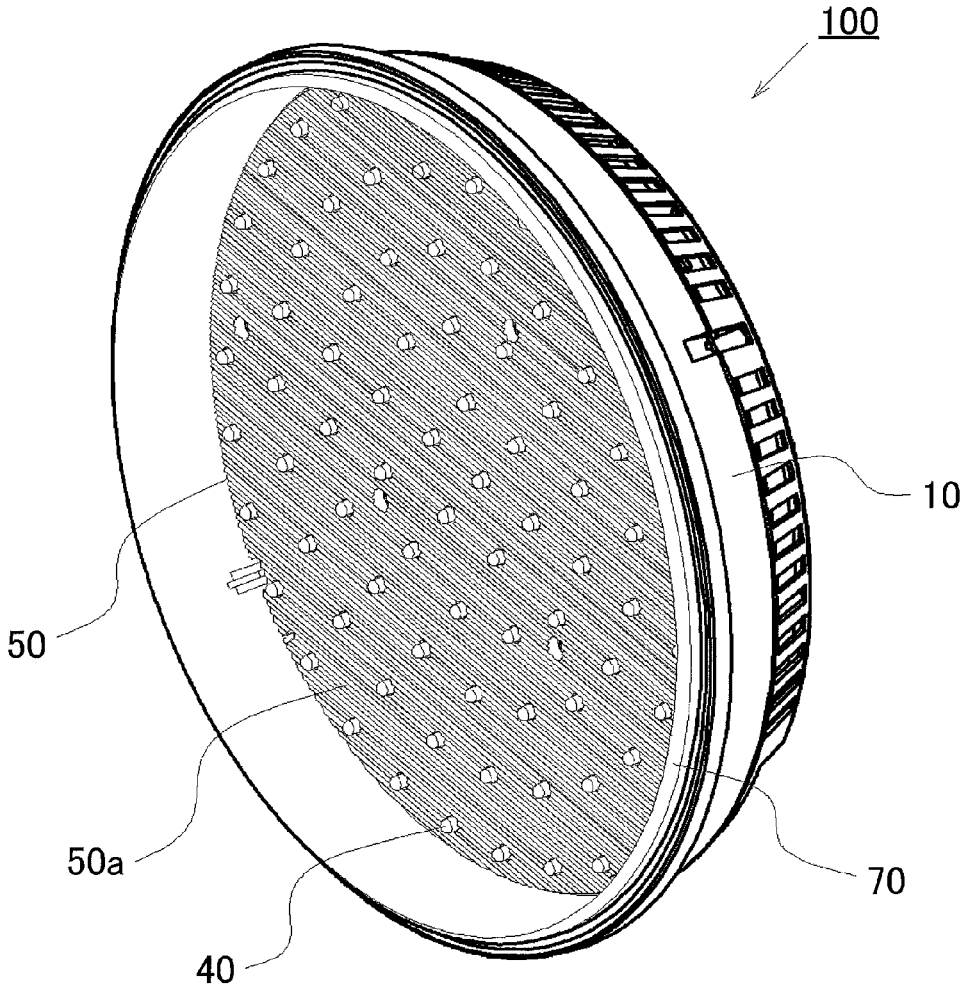
FIG. 1 is an oblique view for describing an embodiment of the LED traffic light.
Figure 2:
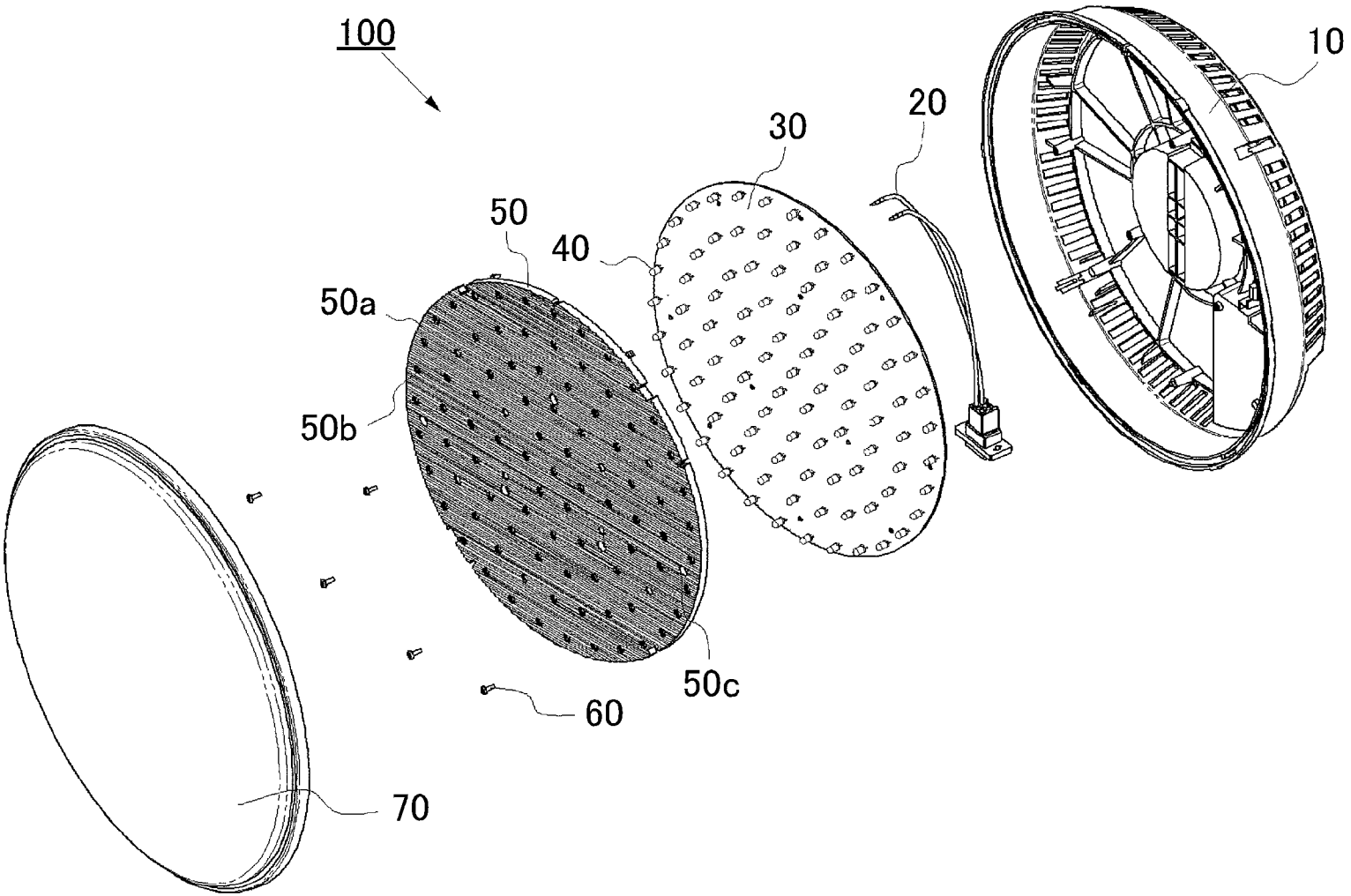
FIG. 2 is an exploded view of an embodiment of the LED traffic light.
Figure 3A:
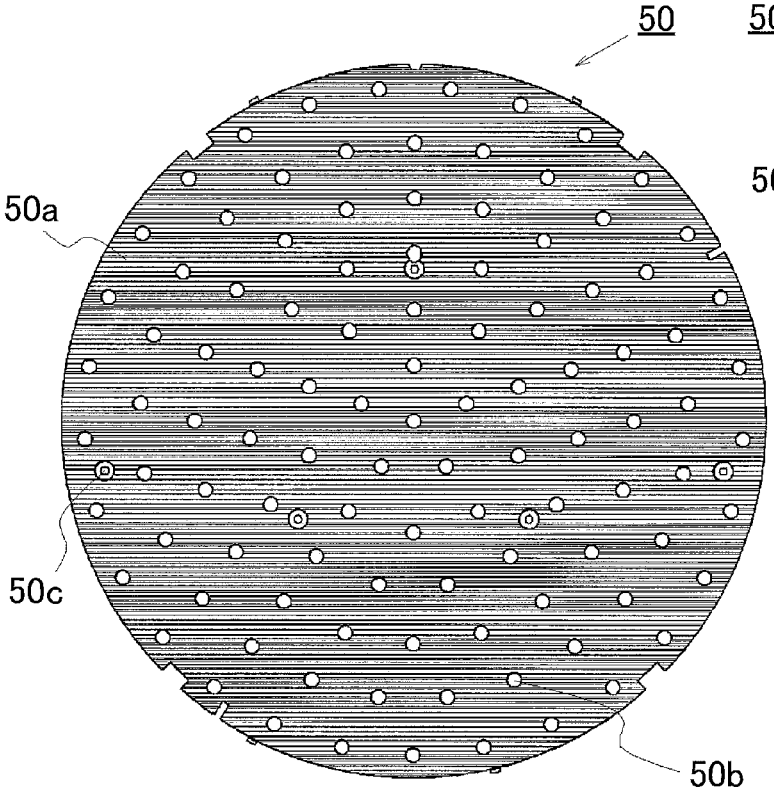
FIGS. 3A, 3B, and 3C are drawings for describing the masking plate used in an embodiment of the LED traffic light.
Figure 3B:
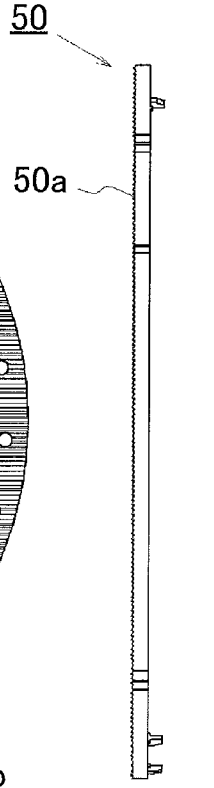
Figure 3C:
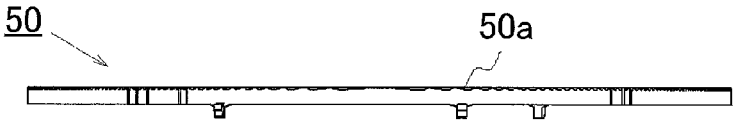
Figure 4:
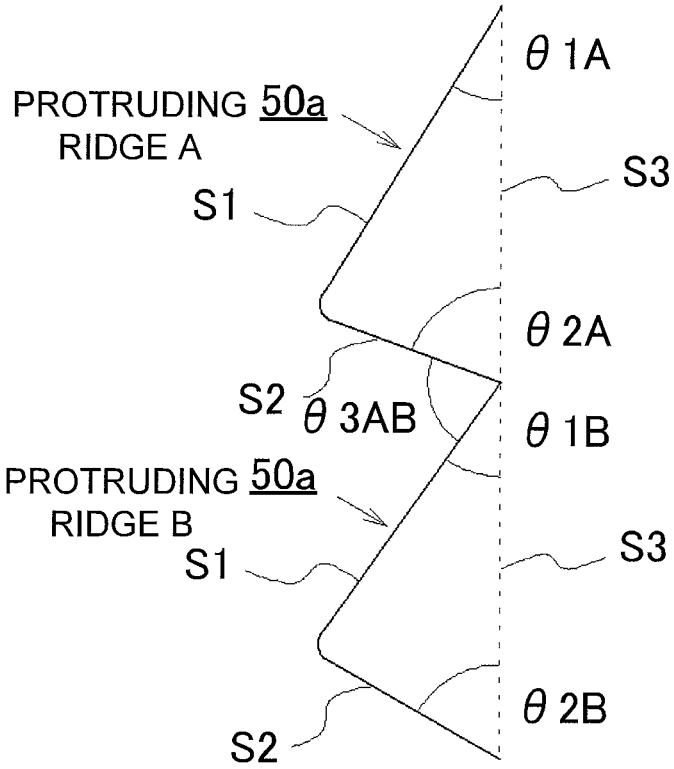
FIG. 4 is a drawing for describing protruding ridges in the masking plate used in the LED traffic light according to the embodiment.

An LED traffic light 100 for the present embodiment is shown in FIGS. 1 and 2. FIG. 1 is an oblique view and FIG. 2 is an exploded view of the LED traffic light 100. FIG. 3 is for the purpose of describing the masking plate 50 used in the LED traffic light 100. FIG. 3A shows the masking plate 50 viewed from the front side (the side for traffic light visual recognition), FIG. 3B shows the masking plate 50 in FIG. 3A viewed from the right side, and FIG. 3C shows the masking plate 50 in FIG. 3A viewed from below. FIG. 4 is for the purpose of detailed description of the protruding ridges 50*a* formed in the masking plate 50 and shows protruding ridge A and protruding ridge B adjacently disposed in the vertical direction. FIG. 5 is for the purpose of describing the array of protruding ridges 50*a* in the masking plate 50 used in the present embodiment.

The LED traffic light 100 shown in the figures is provided with a circuit board 30, a plurality of LEDs 40 mounted on the front side of the circuit board 30, and a masking plate 50 having a plurality of through-holes 50*b* corresponding to the plurality of LEDs 40 mounted on the front side of the circuit board 30. The front side of the masking plate 50 has a plurality of protruding ridges 50*a*, and each protruding ridge 50*a* has an upward facing inclined surface S1 that slants downward at a first angle θ1 and a downward facing inclined surface S2 that slants upward at a second angle θ2, which is larger than the first angle θ1. In addition, the plurality of protruding ridges 50*a* includes two or more types of ridges that have different first angles. This arrangement can suppress LED traffic light glare, which is caused by the bright reflection of light from external sources and which makes visual recognition of the traffic signal difficult. The following expands on this.

First of all, the primary cause of traffic light glare is sunlight or other light emitted from an external source that shines from a horizontal or elevated oblique direction. In this respect, the LED traffic light 100 is configured with the surface area of protruding ridge 50*a* upward facing inclined surfaces S1 made greater than the surface area of downward facing inclined surfaces S2 by making the second angle θ2 larger than the first angle θ1 (θ1 <θ2). This allows the majority of incident light from external sources to be reflected upward by the upward facing inclined surfaces S1. However, since a portion of the incident light is reflected at a downward angle, surface area differences on the sides of the protruding ridges cannot alone sufficiently suppress glare. Therefore, the LED traffic light 100 is further configured to include two or more protruding ridge 50*a* types that have different first angles θ1. This disperses light reflected from the upward facing inclined surfaces S1 in different directions, reduces the amount of reflected light directed at an observer looking up at a given angle to identify the traffic signal, and results in glare reduction. Here, "two or more protruding ridge 50*a* types" means that when the protruding ridges are viewed in cross-section (e.g. FIG. 4), the plurality of protruding ridges includes two or more protruding ridge types that are in fact different from the aspect of cross-sectional size and/or shape. Similarly, "three or more types of protruding ridges (mentioned below)" implies three or more protruding ridge types that are in fact different from the aspect of cross-sectional size and/or shape.

The following describes the major components of the LED traffic light 100.

(Case 10)

The case 10 serves to hold the wire-leads 20, the circuit board 30 with LEDs 40 mounted on its front side, and the masking plate 50. For example, the case 10 is made of (plastic) resin (such as polycarbonate). The case 10 is configured to expose part of the wire-leads 20 out of the backside of the case 10 to allow electrical connection to an external power source.

(Circuit Board 30)

The circuit board 30 is the substrate board material on which the LEDs 40 are mounted and is often called a PCB (printed circuit board). In the LED traffic light 100, a total of 92 LEDs 40 are mounted on the front side of the circuit board 30, and various electronic components are disposed on the backside to drive the LEDs 40.

(LEDs 40)

The light emitting diodes (LEDs) 40 are photonic devices that emit light. In the LED traffic light 100, the LEDs 40 employed are a type that can be mounted with two leads passing through the circuit board 20 and can emit blue light.

The LEDs 40 pass through the through-holes 50*b* established in the masking plate 50, and the tops of the LEDs 40 are configured to protrude out from the front surface of the masking plate 50. Further, the top of each LED 40 as transmissive material formed in a lens shape to narrow the dispersion of light emitted from the LED 40.

It should be clear that LED 40 emission can also be in wavelengths such as red or green, and LEDs 40 of the surface mount type can also be used.

(Masking Plate 50)

The purpose of the masking plate 50 is to suppress glare. The masking plate 50 is disposed on the front side of the circuit board 30 and is made of light blocking material. In the present embodiment, black dyed acrylonitrile-butadiene-styrene (ABS) resin is used for the masking plate 50. To further suppress glare, the masking plate 50 is surface-roughened.

As shown in FIGS. 3A-3C, a plurality of protruding ridges 50*a* are formed extending laterally in lines across the front side of the masking plate 50. (Note that the lateral direction corresponds to horizontal when the LED traffic light is installed normally at a designated site.) As shown in FIGS. 2 and 3A, a plurality of through-holes 50*b* for LED 40 insertion and a plurality of through-holes 50*c* for mounting screw 60 insertion are also formed in the masking plate 50. The masking plate 50 is mounted in the case 10 via screws 60 that pass through the circuit board 30, and the masking plate 50 covers regions of the circuit board 30 where no LEDs 40 are located.

FIG. 4 shows an enlarged vertical cross-section view of one section of protruding ridges 50*a* in the masking plate 50 (where vertical is perpendicular to the lateral direction). As shown in FIG. 4, each protruding ridge 50*a* has an upward facing inclined surface S1 that slants downward at the first angle θ1 and a downward facing inclined surface S2 that slants upward at the second angle θ2, which is greater than the first angle θ1. Here, the first angle θ1 is the angle between a reference plane S3 on which the protruding ridges are disposed and the upward facing inclined surface S1, and the second angle θ2 is the angle between the reference plane S3 and the downward facing inclined surface S2. Note that the reference plane S3 on which the protruding ridges are disposed is not an actual planar surface, but rather when the protruding ridges 50*a* are viewed in vertical cross-section, the reference plane S3 aligns with the third (virtual) side that forms a triangle with the upward facing inclined surface S1 and the downward facing inclined surface S2 of each protruding ridge 50*a*.

Figure 5A:
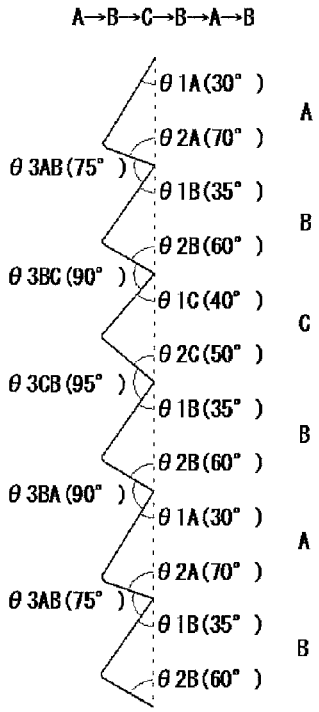
FIGS. 5A, 5B, and 5C are drawings for describing the array of protruding ridges in the masking plate used in the LED traffic light embodiment.
Figure 5B:
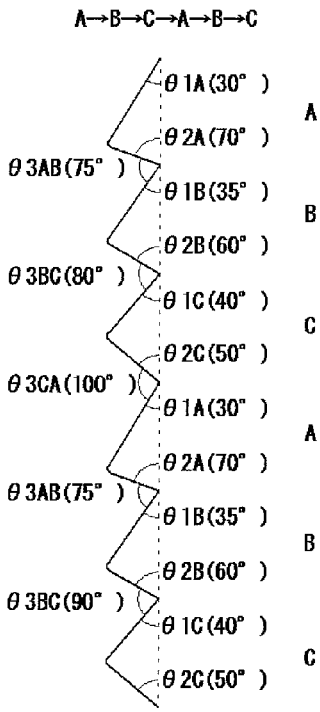
Figure 5C:
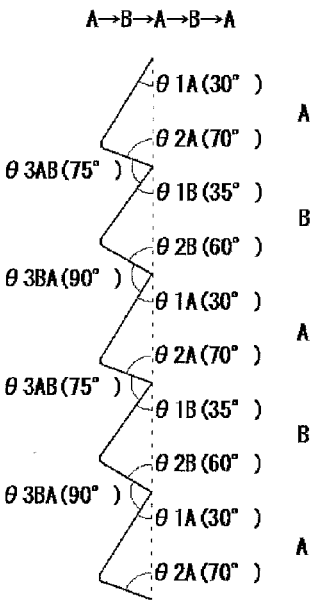

In FIG. 4, the upper protruding ridge 50*a* is identified as protruding ridge "A" and the lower protruding ridge 50*a* is identified as protruding ridge "B." Further, the first angle θ1 of protruding ridge A is labeled "θ1A" and the second angle θ2 of protruding ridge A is labeled "θ2A." Similarly, the first angle θ1 of protruding ridge B is labeled "θ1B" and the second angle θ2 of protruding ridge B is labeled "θ2B." In addition, the angle between the downward facing inclined surface S2 of the upper protruding ridge A and the upward facing inclined surface S1 of the lower protruding ridge B is called the third angle θ3 and is labeled "θ3AB." This nomenclature is also consistently applied in subsequent descriptions related to FIGS. 5A-5C.

FIG. 5A shows an array of masking plate protruding ridges 50*a* used in the LED traffic light 100. As shown in FIG. 5A, the masking plate 50 is provided with protruding ridges A, which have first angles θ1 of 30° (30° is used here for convenience and more accurately the angle is 31.4° and second angles θ2 of 70°, protruding ridges B, which have first angles θ1 of 35° (more accurately) 35.1° and second angles θ2 of 60°, and protruding ridges C, which have first angles θ1 of 40° (more accurately) 40.7° and second angles θ2 of 50°. These different protruding ridges are arranged from top to bottom in a repeating series, which is A, B, C, B, A, B, . . . (namely, A, B, C sequences where the first angle θ1 increases and C, B, A sequences where the first angle θ1 decreases are successively repeated).

When the plurality of different protruding ridges 50*a* are established on the front side of the masking plate 50, it is also possible to dispose protruding ridges 50*a* having a given first angle θ1 next to each other in one vertical section, and protruding ridges 50*a* having a different first angle θ1 next to each other in a different vertical section. For example, while different protruding ridges A, B, C, B, A, B are vertically arranged in FIG. 5A, partially consecutive arrangement such as A, A, B, B, C, C may be employed. It should be noted that it is preferable for vertically adjacent protruding ridges 50*a* to have different first angles θ1 over the entire front side of the masking plate 50 as shown in FIG. 5A. This arrangement allows light to be reflected in different directions from the upward facing inclined surfaces S1 of vertically adjacent protruding ridges 50*a*. Specifically, glare can be suppressed more by avoiding (successive vertical) repetition of protruding ridges that reflect light in the same direction.

As shown in FIG. 5A, the plurality of protruding ridges 50*a* can include two or more types of protruding ridges 50*a* that have different second angles θ2. This disperses light reflected from the downward facing inclined surfaces S2 in different directions, reduces the amount of reflected light directed at an observer looking up at a given angle to identify the traffic signal, and results in glare reduction.

When the plurality of different protruding ridges 50*a* are established on the front side of the masking plate 50, it is also possible to dispose protruding ridges 50*a* having a given second angle θ2 next to each other in one vertical section, and protruding ridges 50*a* having a different second angle θ2 next to each other in a different vertical section. However, it is preferable for vertically adjacent protruding ridges 50*a* to have different second angles θ2 over the entire front side of the masking plate 50 as shown in FIG. 5A. This arrangement allows light to be reflected in different directions from the downward facing inclined surfaces S2 of vertically adjacent protruding ridges 50*a*. Specifically, glare can be suppressed more by avoiding (successive vertical) repetition of protruding ridges that reflect light in the same direction.

As shown in FIG. 5A, the plurality of protruding ridges 50*a* can include three or more types of protruding ridges that have different first angles θ1 (FIG. 5A has three different types of protruding ridges A-C). Since this can reflect light in three or more different directions from the upward facing inclined surfaces S1, it can further suppress glare generation. However, if the number of protruding ridge 50*a* types having different first angles θ1 is increased without reason, the difference between first angles θ1 of adjacent protruding ridges 50*a* is inevitably reduced and the effectiveness for glare-suppression decreases. Therefore, the number of protruding ridge 50*a* types with different first angles θ1 can be set from 3 to 6 different types, preferably from 3 to 5 different types, and more preferably from 3 to 4 different types.

As shown in FIG. 5A, the plurality of protruding ridges 50*a* can include three or more types of protruding ridges that have different second angles θ2 (FIG. 5A has three different types of protruding ridges A-C). Since this can reflect light in three or more different directions from the downward facing inclined surface S2, it can further suppress glare generation. However, if the number of protruding ridge 50*a* types having different second angles θ2 is increased without reason, the difference between second angles θ2 of adjacent protruding ridges 50*a* is inevitably reduced and the effectiveness for glare-suppression decreases. Therefore, the number of protruding ridge 50*a* types with different second angles θ2 can be set from 3 to 6 different types, preferably from 3 to 5 different types, and more preferably from 3 to 4 different types.

If there is little difference between the first angles θ1 of two (vertically) adjacent protruding ridges 50*a*, the effectiveness for glare-suppression is small. In contrast, if there is a large difference between the first angles θ1 of two adjacent protruding ridges 50*a*, bright horizontal lines can appear in certain regions and dark horizontal lines can appear in (vertically) adjacent regions when viewed at an angle from below. This gives the traffic light a visually unpleasing appearance. Therefore, the difference between first angles θ1 of (vertically) adjacent protruding ridges 50*a* can be set from 5° to 20°, preferably from 5° to 15°, and more preferably from 7° to 13°. Similarly, the difference between second angles θ2 of (vertically) adjacent protruding ridges 50*a* can be set from 3° to 15°, preferably from 3° to 10°, and more preferably from 3° to 8°.

If the first angle θ1 of a protruding ridge 50*a* is smaller, then the orientation of the upward facing inclined surface S1 becomes closer to parallel to the reference plane, i.e., the plane of the masking plate, thus lesser upward light reflection can be expected from the upward facing inclined surface S1. Conversely, if the first angle θ1 is made large in condition that the height and the width of all protruding ridges 50*a* maintained, the second angle θ2 must decrease, and as a result, the surface area of the downward facing inclined surface S2 increases. This is problematic because it increases the amount of light reflected downward. Therefore, the first angle θ1 can be set from 20° to 44°, preferably from 25° to 43°, and more preferably from 27° to 42°.

If the second angle θ2 of a protruding ridge 50*a* is made small, the surface area of the downward facing inclined surface S2 increases and the amount of light reflected downward increases. Conversely, a large second angle θ2 is problematic because the downward direction of reflected light increases. Therefore, the second angle θ2 can be set from 16° to 80°, preferably from 25° to 45°, and more preferably from 30° to 45°.

If the width of a protruding ridge 50*a* (protruding ridge 50*a* width in the vertical direction of FIG. 4) is too wide or too narrow, the effectiveness for glare-suppression decreases. Therefore, protruding ridge vertical width can be set from 1 mm to 5 mm, preferably from 1 mm to 3 mm, and more preferably from 1.5 mm to 2.5 mm. The plurality of protruding ridges 50*a* can be configured with all the protruding ridges having the same width or with protruding ridges having different widths. Making all the protruding ridge widths the same has the advantage of simplifying fabrication of the masking plate mold. In the present embodiment, protruding ridges 50*a* are all set to a uniform width of 2 mm.

If the height of a protruding ridge 50*a* (lateral protrusion of a protruding ridge 50*a* in the cross-section of FIG. 4) is too high or too low, the effectiveness for glare-suppression decreases. Therefore, protruding ridge height can be set from 0.5 mm to 2 mm, preferably from 0.5 mm to 1.5 mm, and more preferably from 0.8 mm to 1.2 mm. The plurality of protruding ridges 50*a* can be configured with all the protruding ridges having the same height or with protruding ridges having different heights. Making all the protruding ridge heights the same has the advantage of simplifying fabrication of the masking plate mold. In the present embodiment, protruding ridges 50*a* are all set to a uniform height of 1 mm.

In the array of protruding ridges in FIG. 5A, the third angle θ3 has a maximum value of 95° (θ3CB). However, in the array in FIG. 5B, which uses the same protruding ridges A-C of FIG. 5A but with the arrangement A, B, C, A, B, C, . . . (namely, A, B, C sequences where the first angle θ1 increases are successively repeated), the maximum value of the third angle θ3 becomes 100° (θ3CA). In the array in FIG. 5B, the angle between the downward facing inclined surface S2 of protruding ridge C and the upward facing inclined surface S1 of protruding ridge A)(θ3CA=100° is closer to straight angle compared to the array in FIG. 5A. This configuration makes it more likely for a bright horizontal line to appear. Therefore, when three different types of protruding ridges are used, it is desirable to arrange the protruding ridges 50*a* in a manner (as shown in FIG. 5A) that prevents the third angle θ3 from becoming a maximum value. Here, the third angle θ3 is the angle between the downward facing inclined surface S2 of the upper protruding ridge and the upward facing inclined surface S1 of the lower protruding ridge of two vertically adjacent protruding ridges 50*a*. Specifically, it is desirable to avoid disposing a protruding ridge with a minimum second angle θ2 immediately above a protruding ridge with a minimum first angle θ1.

The embodiment described above has a masking plate 50 that is provided with three different types of protruding ridges A-C. However, as shown in FIG. 5C, the masking plate 50 can also be provided with two types of protruding ridges 50*a* having different first angles θ1. (The masking plate 50 in FIG. 5C is formed with two types of protruding ridges A and B.) Although this configuration reflects light from the upward facing inclined surfaces S1 in two directions instead of three, sufficient glare-suppressing effectiveness can be expected compared to a configuration with the same first angle θ1 in adjacent protruding ridges 50*a*. In the case of a masking plate provided with two different protruding ridges (instead of three), it is also desirable for adjacent protruding ridges 50*a* to have different second angles θ2. This is for the purpose of reflecting light downward in different directions as described previously. Although the embodiments described above have different first angles θ1 as well as different second angles θ2 for each protruding ridge 50*a* type, it is also possible to make at least the second angle θ2 substantially the same for all the different types of protruding ridges.

(Transmissive Cover 70)

The LED traffic light 100 is provided with a transmissive cover 70 on the front side. The transmissive cover 70 is the part of the traffic light that transmits light from the LEDs 40 to the outside and also serves to prevent the ingress of moisture (e.g. rainwater). Here, the transmissive cover 70 is made of polycarbonate resin. The transmissive cover 70 is configured to fit together with the case 10 and hold the traffic light components including the circuit board 30 and LEDs 40 inside.

Preferably, the inside surface of the transmissive cover 70 is surface-roughened to a degree that does not degrade visual recognition. This surface treatment avoids discerning bright lines and dark lines even in the case where the masking plate 50 generates those lines. It should be apparent to those with an ordinary skill in the art that while various preferred embodiments of the invention have been shown and described, it is contemplated that the invention is not limited to the particular embodiments disclosed, which are deemed to be merely illustrative of the inventive concepts and should not be interpreted as limiting the scope of the invention, and which are suitable for all modifications and changes falling within the spirit and scope of the invention as defined in the appended claims. The present application is based on Application No. 2013-098052 filed in Japan on May 8, 2013 and Application No. 2014-085940 filed in Japan on Apr. 17, 2014, the contents of which are incorporated herein by references.

What is claimed is:

1. An LED traffic light comprising:

a circuit board having a front side;

a plurality of LEDs provided on the front side of the circuit board; and a masking plate having a front side and a back side opposite to the front side of the masking plate, the masking plate having a plurality of through-holes passing through the masking plate from the back side to the front side of the masking plate, the masking plate being provided such that the back side of the masking plate faces the front side of the circuit board and the plurality of through-holes corresponds to the plurality of LEDs, the masking plate having a plurality of protruding ridges on the front side of the masking plate, each of the plurality of protruding ridges having an upward facing inclined surface that slants downward at a first angle and a downward facing inclined surface that slants upward at a second angle larger than the first angle, the plurality of protruding ridges including a first ridge and a second ridge, the first angle of the first ridge being different from the first angle of the second ridge.

2. The LED traffic light as cited in claim 1 wherein the plurality of protruding ridges are disposed with different first angles in two vertically adjacent protruding ridges.

3. The LED traffic light as cited in claim 2 wherein a difference between the different first angles of two vertically adjacent protruding ridges is greater than or equal to 5° and less than or equal to 20°.

4. The LED traffic light as cited in claim 1 wherein the second angle of the first ridge is different from the second angle of the second ridge.

5. The LED traffic light as cited in claim 4 wherein the plurality of protruding ridges are disposed with different second angles in two vertically adjacent protruding ridges.

6. The LED traffic light as cited in claim 5 wherein the plurality of protruding ridges are disposed with different first angles in two vertically adjacent protruding ridges.

7. The LED traffic light as cited in claim 5 wherein a difference between the different second angles of two vertically adjacent protruding ridges is greater than or equal to 3° and less than or equal to 15°.

8. The LED traffic light as cited in claim 4 wherein the plurality of protruding ridges include three or more different angles as the first angle.

9. The LED traffic light as cited in claim 8 wherein the plurality of protruding ridges include greater than or equal to three different angles and less than or equal to six different angles as the first angle.

10. The LED traffic light as cited in claim 8 wherein the plurality of protruding ridges include three or more different angles as the second angle.

11. The LED traffic light as cited in claim 10 wherein the plurality of protruding ridges are disposed in a manner that avoids a maximum valued third angle, which is an angle between the downward facing inclined surface of an upper protruding ridge and the upward facing inclined surface of a lower protruding ridge of two vertically adjacent protruding ridges.

12. The LED traffic light as cited in claim 10 wherein the plurality of protruding ridges include greater than or equal to three different angles and less than or equal to six different angles as the second angle.

13. The LED traffic light as cited in claim 1 wherein the plurality of protruding ridges include three or more different angles as the second angle.

14. The LED traffic light as cited in claim 1 wherein a protruding ridge width in a vertical direction is greater than or equal to 1 mm and less than or equal to 5 mm.

15. The LED traffic light as cited in claim 14 wherein all of the plurality of protruding ridges have a same vertical width.

16. The LED traffic light as cited in claim 1 wherein a protrusion height of each of the plurality of protruding ridges is greater than or equal to 0.5 mm and less than or equal to 2 mm.

17. The LED traffic light as cited in claim 16 wherein all of the plurality of protruding ridges have a same protrusion height.

18. The LED traffic light as cited in claim 1 wherein the first angle is in a range greater than or equal to 20° and less than or equal to 44°.

19. The LED traffic light as cited in claim 1 wherein the second angle is in a range greater than or equal to 46° and less than or equal to 80°.

20. An LED traffic light comprising:

a circuit board having a front side;

a plurality of LEDs provided on the front side of the circuit board; and a masking plate having a front side and a back side opposite to the front side of the masking plate, the masking plate having a plurality of through-holes passing through the masking plate from the back side to the front side of the masking plate, the masking plate being provided such that the back side of the masking plate faces the front side of the circuit board and the plurality of through-holes corresponds to the plurality of LEDs, the masking plate having a plurality of protruding ridges on the front side of the masking plate, each of the plurality of protruding ridges having an upward facing inclined surface that slants downward at a first angle and a downward facing inclined surface that slants upward at a second angle larger than the first angle, the plurality of protruding ridges including a first ridge and a second ridge, the second angle of the first ridge being different from the second angle of the second ridge.

21. The LED traffic light as cited in claim 20 wherein the plurality of protruding ridges are disposed with different second angles in two vertically adjacent protruding ridges.

22. The LED traffic light as cited in claim 20 wherein the plurality of protruding ridges include three or more different angles as the second angle.

23. The LED traffic light as cited in claim 22 wherein the plurality of protruding ridges are disposed in a manner that avoids a maximum valued third angle, which is an angle between the downward facing inclined surface of an upper protruding ridge and the upward facing inclined surface of a lower protruding ridge of two vertically adjacent protruding ridges.

* * * * *

UNITED STATES PATENT AND TRADEMARK OFFICE

CERTIFICATE OF CORRECTION

PATENT NO. : 9,064,410 B2
APPLICATION NO. : 14/266843
DATED : June 23, 2015
INVENTOR(S) : Tomohiko Hatano It is certified that error appears in the above-identified patent and that said Letters Patent is hereby corrected as shown below:

On the Title page, item (30) should read as follows:

(30) Foreign Application Priority Data

May 8, 2013 (JP) .....2013-098052
April 17, 2014 (JP) .....2014-085940

Signed and Sealed this
Twentieth Day of October, 2015

Michelle K. Lee

Michelle K. Lee
*Director of the United States Patent and Trademark Office*